United States Patent [19]

Matsumoto et al.

[11] 4,188,691

[45] Feb. 19, 1980

[54] PROCESS AND APPARATUS FOR CRIMPING FILAMENT YARN

[75] Inventors: Mitsuo Matsumoto; Kazushige Hayashi; Tsutomu Nakamura; Minoru Yamachika, all of Osaka, Japan

[73] Assignee: Teijin Limited, Osaka, Japan

[21] Appl. No.: 834,922

[22] Filed: Sep. 20, 1977

[30] Foreign Application Priority Data

Oct. 5, 1976 [JP] Japan ..... 51/119004

[51] Int. Cl.[2] ..... D02G 1/12; D02G 1/16; D02G 1/20

[52] U.S. Cl. ..... 28/255; 28/263; 23/271

[58] Field of Search ..... 239/421, 543, 545; 28/254, 255, 256, 257, 258, 262, 263, 265, 266, 267, 271, 273, 221

[56] References Cited

U.S. PATENT DOCUMENTS

| | | | |
|---|---|---|---|
| 3,593,395 | 7/1971 | Stanley | 28/221 |
| 3,849,844 | 11/1974 | Bauch | 28/255 |
| 3,886,636 | 6/1975 | Borenstein et al. | 28/265 |
| 3,977,057 | 8/1976 | Fernandez | 28/266 |
| 4,040,153 | 8/1977 | Hatcher et al. | 28/221 |

FOREIGN PATENT DOCUMENTS

| | | | |
|---|---|---|---|
| 4736220 | 9/1972 | Japan | 28/255 |

*Primary Examiner*—Louis Rimrodt
*Attorney, Agent, or Firm*—Sughrue, Rothwell, Mion, Zinn and Macpeak

[57] ABSTRACT

Process and apparatus for crimping a filament yarn, the process employed comprising forcing a hot fluid entrained filament yarn into a stuffing chamber in one direction, forcing a cold fluid from an opposite direction into a staying control chamber located down stream of said stuffing chamber, exhausting said hot fluid from the stuffing chamber and exhausting said cold fluid from the staying control chamber respectively.

The apparatus comprises a hot fluid jet nozzle having a hot fluid supply conduit connected thereto, a stuffing chamber having a hot fluid exit, a staying control chamber having a cold fluid exit, and a cold fluid supply device in said order.

22 Claims, 3 Drawing Figures

PROCESS AND APPARATUS FOR CRIMPING FILAMENT YARN

BACKGROUND OF THE INVENTION

The present invention relates to the crimping of a filament yarn and more particularly to a process and an apparatus for crimping a filament yarn.

In recent years, in case of crimping a filament yarn, a so-called air stuffing crimping, which introduces a hot fluid entrained filament yarn into a stuffing chamber by use of a fluid jet nozzle, has been studied, because of its high-speed crimping and compactness of its apparatus.

According to the conventional methods of air stuffing crimping, high-speed crimping of filament yarn is possible, because the filament yarn is crimped efficiently by being plasticized with a hot fluid inside the hot fluid jet nozzle, and also by being subjected to hot fluid turbulence and then being stuffed into the stuffing chamber.

Moreover, the apparatus for air stuffing can be made very campactly with its stuffing chamber combined with a hot fluid jet nozzle.

However, in case of the above-mentioned process, it is very difficult to produce uniformly crimped yarn, because qualities of obtained crimped filament yarn, for example, crimp percentage, number of crimps, modulus of crimp, etc., are inclined to vary due to fluctuations occurring with the position of the stuffing start point (distance from the hot fluid jet nozzle to the filament yarn block already packed tightly in the stuffing chamber), stuffing density of filament yarn, releasing point, cooling of crimped filament yarn and so on.

From the above viewpoint, attmepts have been made to facilitate crimp fixing of filament yarn by the application of a cold fluid supplied into the stuffing chamber from an opposite direction, also of back pressure caused by the cold fluid on the filament yarn packed in the stuffing chamber (see U.S. Pat. No. 3802038, U.S. Pat. No. 3849844, Japanese Patent Application Laid-open No. 71242/74, Australian Pat. No. 74/76203, U.S. Pat. No. 3824656).

However, these processes are so composed as to let both the hot fluid and the cold fluid exhaust from the stuffing chamber, therefore it is difficult to keep the pressure balance between the hot fluid and the cold fluid under control, and any pressure unbalance thus occurring inevitably varies the position of the stuffing start point in the stuffing chamber, stuffing density, releasing point and so on.

In order to prevent these phenomena, means for controlling the pressure of both the hot and the cold fluid in said stuffing chamber has been proposed by providing a pressure control valve on the exhausting conduit of the stuffing chamber, but the system of this apparatus is complicated and unpractical (see U.S. Pat. No. 3802038, U.S. Pat. No. 3849844).

SUMMARY OF THE INVENTION

It is a general object of the present invention to overcome the disadvantage of the prior art.

It is an object of the present invention to provide a process for fluid stuffing crimping of filament yarn.

It is another object of the present invention to provide an apparatus for fluid stuffing crimping of filament yarn.

According to the present invention, it has now been discovered that a fluid stuffing crimping process and apparatus may be employed for high speed production of uniformly crimped filament yarn having desirable crimp form.

The process employed comprises forcing a hot fluid entrained filament yarn into a stuffing chamber in one direction, forcing a cold fluid from an opposite direction into a staying control chamber located down stream of said stuffing chamber, exhausting the hot fluid from said stuffing chamber and exhausting the cold fluid from said staying control chamber.

The above-mentioned process can be attained by use of the apparatus according to the present invention comprising a hot fluid jet nozzle, a stuffing chamber having a hot fluid exit, a staying control chamber having a cold fluid exit, and cold fluid supply device.

Further features and advantages of the present invention will be apparent from the following descriptions, reference being made to the attached drawings.

DESCRIPTION OF THE PREFERRED EMBODIMENTS

Figure 1:
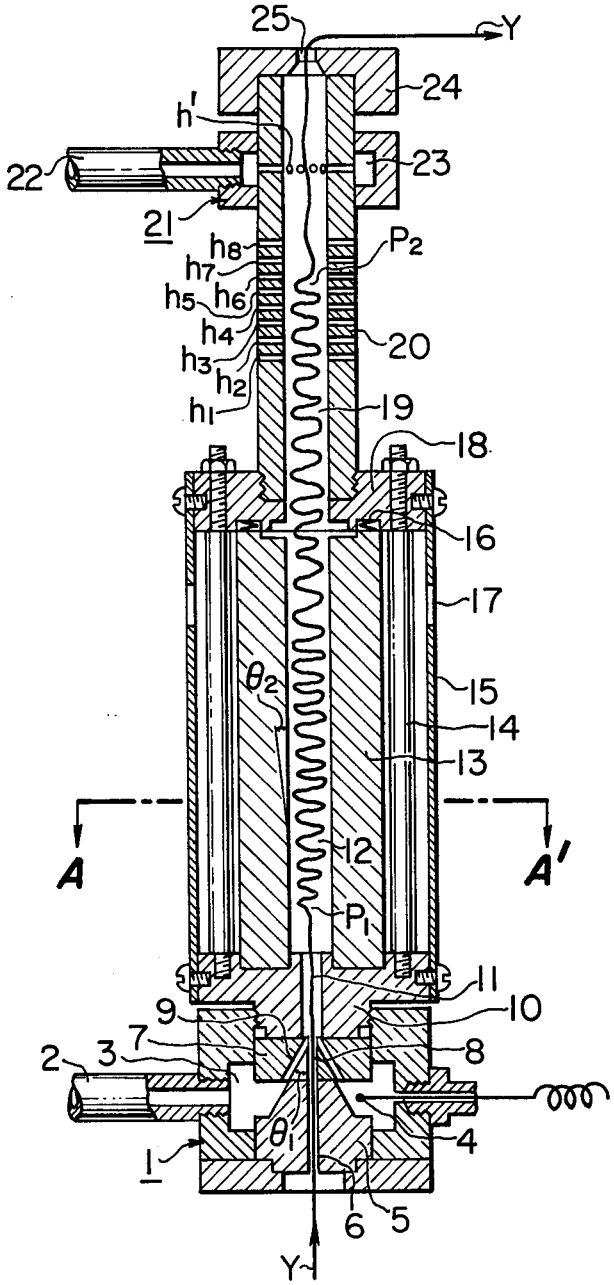
FIG. 1 is a diagrammatic longitudinal section illustrating an embodiment of an apparatus in accordance with the present invention.
Figure 2:
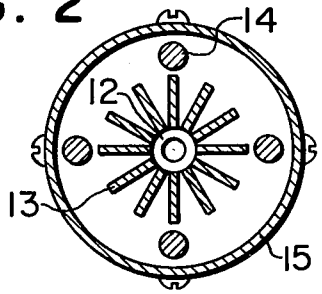
FIG. 2 is a section taken on line A–A′ of FIG. 1.

Turning to FIGS. 1 and 2, the apparatus for use in conjunction with this invention is composed of a hot fluid jet nozzle 1, stuffing chamber 12 having means for exhausting the hot fluid (lamellae 13), staying control chamber 19 having means for exhausting the cold fluid (control perforations $h_1$–$h_8$), and device 21 for supplying the cold fluid.

The filament yarn Y is led and inserted into the yarn processing bore 6 of the adapter 5, yarn processing bore 8 of the piece 7 and yarn processing bore 11 of the plug 10, then whipped and jetted by the hot fluid which flows flashing through the hot fluid jet bore 9 by way of the hot fluid supply conduit 2 and the hot fluid chamber 3, and is further impinged at stuffing start point $P_1$ upon the filament yarn block already staying in the stuffing chamber to form crimps.

Incidentally, the distance between the end of the yarn processing bore on the plug and the stuffing start point $P_1$ is 0–50 mm, preferably 5–25 mm.

When said distance exceeds 50 mm, the resulting filament yarn can not be crimped well and a lack of crimping uniformity in the filament yarn occurs.

Then, the hot fluid is diffused radially through spaces of the lamellae 13 (forming the exit conduit of the hot fluid) as it flows in the direction of the processed yarn in the stuffing chamber, and is then vented out of the system through the hot fluid exhausting conduit 17 on the cover 15.

Although the pressure and temperature of the hot fluid, of course, vary depending upon the filament yarn being treated, the hot fluid is hot air under pressure ranging from 3 to 20 kg/cm$^2$, and temperature of 150°–300° C., preferably from 4 to 10 kg/cm$^2$, and 180°–250° C., and steam under pressure ranging from 3 to 20 kg/cm$^2$ and temperature of 130°–250° C., preferably from 4 to 10 kg/cm$^2$ and 160°–230° C.

Preferred advancement speed or feed rate of the filament yarn into the yarn processing bore of the hot fluid jet nozzle is in the range of 300 to 4,000 meters per minute, preferably 1,000 to 3,000 meters per minute.

Next, the filament yarn block formed in the stuffing chamber moves toward the staying control chamber, while the cold fluid is supplied into the staying control chamber from an opposite direction through the cold fluid perforations h' communicated with the cold fluid supply device 21 comprising a cold fluid supply conduit 22 and cold fluid chamber 23.

Consequently, the resulting back pressure working upon all the filament yarn block affects the increment of crimping and the cooling of filament yarn by the cold fluid in the staying control chamber fixes the crimp.

The cold fluid is vented radially through the control perforations $h_8$–$h_1$, which work as the cold fluid exhausting conduits, disposed in the walls of said staying control chamber.

When the filament yarn is released from the filament yarn block in the staying control chamber at a point downstream of the releasing point $P_2$, for instance, at the point around perforation $h_3$, the volume of exhausting cold fluid increases, thus lowering the back pressure caused by the cold fluid, which arouses the releasing point $P_2$ to resume its previous position.

When the filament yarn is released from the filament yarn block at a point upstream of the releasing point $P_2$, for instance, at the point hear the control perforation $h_8$, the volume of the exhausting cold fluid decreases, thus raising the back pressure, which pushes down the point $P_2$, thus always controlling point $P_2$ to stay at the proper position.

The standardization of both the cooling condition and the back pressure is accordingly effected satisfactorily.

Consequently, the pressure balance between the hot fluid and the cold fluid is effectively controlled, the stuffing start point $P_1$ is standardized, and moreover unevenness in the stuffing density, volume of the filament yarn, working time and so on in the stuffing chamber and the staying control chamber is much less liable to occur.

The present invention has successfully made it possible to acheive crimping efficiency much higher than usual fluid crimping in producing uniform crimped filament yarn by bringing the staying control chamber into the apparatus besides the stuffing chamber, whereby the hot fluid is exhausted from the stuffing chamber and the cold fluid from the staying control chamber respectively.

As for the cold fluid, the fluid may also be made to contain water, preferably sprayed water in order to have the crimp fixing bettered by thus modified cooling and, on the other hand, to retard excess increment of crimping as disclosed in the U.S. Pat. No. 3271493.

Likewise, a solution of coloring matter or finishing oil may be admixed with the cold fluid so that after processes may be omitted.

The qualities of resulted crimped filament yarn are determined not only by the position of the stuffing start point in the stuffing chamber, but also by various other conditions.

And the present invention offers the stuffing density of 0.05–0.4 g/cm$^3$, preferably 0.1–0.3 g/cm$^3$, and the working time in the stuffing chamber and the staying control chamber ranging from 0.1 to 5 seconds, preferably from 0.4 to 3.0 seconds.

And the cold fluid used in the present invention is controlled to have a pressure of 0.1–5.0 kg/cm$^2$, preferably 0.4–3.0 kg/cm$^2$, and a temperature of 0°–100° C., preferably 20°–40° C.

In the apparatus of this invention, the hot fluid jet nozzle 1 is composed of the hot fluid supply conduit 2, hot fluid chamber 3, adapter 5, piece 7, and plug 10.

A thermometer 4 is inserted into the hot fluid chamber 3 in order to regulate the hot fluid by a temperature indicator controller (not indicated in the Figure).

To obtain the efficiency in effecting prompt and smooth guiding of the filament yarn as well as its knots with their pigtails into the yarn processing bore of the adapter, its diameter ($A_D$) should be 1.5 mm or more ($A_D \geqq 1.5$ mm).

In the case of high speed crimping, where the feed rate is 1,500 meters per minute or higher, especially in the case of continuous threading of high speed processing yarn into the yarn processing bore in direct spinning drawing texturing (or crimping) yarn process (SDTY) and the like, the yarn processing bore 6 should have a diameter of 1.8 mm or more, preferably 2.6 mm or more. At the point where the hot fluid is jetted into the yarn processing bore through the hot fluid jet bore 9, the ratio of the diameter ($A_D$) of the yarn processing bore 6 to the diameter ($P_D$) of the yarn processing bore 8 should be made less than 1.0, preferably 0.8 when high speed crimping is required ($A_D/P_D \leqq 1.0$).

Otherwise, the hot fluid will flow upstream through the yarn processing bore 6 of the adapter and cut the filament yarn frequently.

And the ratio of the diameter ($P_d$) of the hot fluid jet bore 9 to the diameter ($P_D$) of the yarn processing bore 8 should be less than 0.8, preferably less than 0.7 ($P_d/P_D \leqq 0.8$).

Thus, the filament yarn taken off from the apparatus has the good spreading quality, and the resulted crimped filament yarn has the degree of interlace ranging from 2 to 60 per meter which provides the good tufting properties in the preparation of carpets.

The diameter ($P_d$) of the hot fluid jet bore 9 should be more than 1.0 mm taking the suction tension of the filament yarn into consideration, and more than 1.5 mm, preferably 1.7 mm in case of high speed crimping ($P_d \geqq 1.0$ mm).

When the diameter ($P_d$) is less than 1.0 mm, the entraining power of the hot fluid drops resulting in the decrease of tension of the filament yarn even when the hot fluid pressure is raised to a possible extent. The tension drop in the filament yarn before it enters into the yarn processing bore frequently induces the wrapping of filament yarn around the feed rolls set in front of the crimping apparatus.

In consideration of all the above-mentioned conditions, the yarn processing bore ($P_D$) of the piece should be made more than 1.5 mm, and more than 2.25 mm in case of high speed crimping.

Further, the diameter ($P_D$) is preferably less than 6 mm, more preferably 3 mm in order to maintain the dense crimp uniformity of the resulted crimped yarn.

And the diameter ($PL_D$) of the yarn processing bore 11 of the plug is preferably more than the diameter ($P_D$) of the yarn processing bore of the piece.

When the diameter $PL_D$ is too large, the stuffing state of the filament yarn becomes unstable in the stuffing chamber and the resulted crimp lacks crimp uniformity.

The diameters $PL_D$ should therefore be less than 10 mm, preferably 3 mm.

And the yarn processing bore of the plug may be eighter straight or flared at its downstream portion.

Moreover, the hot fluid jet bore 9 of the piece is disposed in plurality at an angle of approximately from 10° to 50°, preferably 20° to 40° with the axis of the yarn processing bore 8 as in the case of conventional hot fluid jet nozzles.

The cross sectional shape of the yarn processing bore of the adapter had better meet the following conditions in case of high speed crimping conducted at the feed rate of more than 1,500 meters per minute:

| | |
|---|---|
| $A_D \geqq 2.6$ mm | (a) |
| $A_D/P_D \leqq 0.8$ | (b) |
| $P_d/P_D \leqq 0.8$ | (c) |
| $P_d \geqq 1.7$ mm | (d) |
| $P_D \leqq 3.0$ mm | (e) |

But in case of high speed crimping conducted at the feed rate of more than 1500 meters per minute, the above-mentioned conditions can not be met by the use of a yarn processing bore of the adapter having a circular section.

Consequently, in case of high speed crimping conducted at the feed rate of more than 1500 meters per minute, the above-mentioned conditions can be satisfied by the use of a yarn processing bore of the adapter having an oval sectional view.

The above-mentioned conditions are satisfied with the use of a yarn processing bore having an oval section with a long diameter of more than 2.6 mm and a short diameter calculated from the areas of respective circles mentioned in the above conditions (a) to (e).

To give a concrete example, the yarn processing oval bore having a 2.6 mm long diameter and 1.5 mm short diameter, with an area equal to that of a circle with 2.1 mm diameter, will be presented.

But when a worker becomes skilled in threading the filament yarn into the yarn processing bore by use of a slim threading hook, there is no necessity of making the yarn processing bore, oval and an adapter having a circular bore of 1.8 mm or more in diameter is applicable despite the conditions (a)–(e) mentioned above.

The hot fluid jet nozzle 1 according to this invention should not necessarily be construed as limiting the spirit of this invention.

For example, a hot fluid jet nozzle suitable for crimping process in accordance with this invention may be any hot stream fluid jet nozzle disclosed in Japanese Pat. No. 3867/73, or any hot turbulent fluid jet nozzle disclosed in U.S. Pat. No. 3186155.

At any rate, the size of the hot fluid jet nozzle for use in conjunction with this invention may be selected in accordance with the kind of the filament yarn, total denier and crimping conditions and so on.

Further, the stuffing chamber 12 is made of an assembled unit of lamellae 13 as illustrated in FIG. 2, having lamellae ranging from 10 to 30 in number, preferably from 12 to 16, provided radially extending from the plug 10 to the joint 18, and the unit of lamellae 13 is secured in its place by means of fixing materials 14 having screws cut at both ends.

Furthermore, the fixing materials 14 are covered with a cover 15 which is provided with an exhausting conduit 17.

A flexible member 16, for instance, a spring, is set between the respective lamellae 13 and the joint 18 (and/or the plug 10) in order to prevent thermal distortion of the lamellae 13 caused by the hot fluid.

Although crimping conditions vary depending upon the total denier of the filament yarn to be treated, the space between lamellae 13 at their root, where the stuffing chamber 12 is formed, is preferably from 0.3 mm to 2 mm, and each lamella is preferably from 0.5 mm to 2 mm thick.

When the space is not more than 0.3 mm, the filament yarn is apt to be caught in the space.

On the other hand when the space is more than 2 mm, the filament yarn bulges of the space.

And it is important to have the configuration of the lamella so designed as to make a narrow entrance for the stuffing chamber forming a flare at an angle of $\theta_2$ for approximately half of the whole length of the stuffing chamber; thereafter the lamellae form a cylindrical chamber.

Although the crimping conditions may vary depending upon the feed rate and filament yarn denier, the angle of $\theta_2$ ranges from 0.5° to 5°, preferably 1° to 3°, and the lamellae are disposed to form the entrance to the stuffing chamber ranging from 2 mm to 20 mm in diameter, preferably 3 mm to 12 mm, and the exit ranging from 4 mm to 40 mm in diameter, preferably from 8 mm to 12 mm.

The length of lamellae may be more than 10 mm in length, preferably from 100 mm to 200 mm.

When the longitudinal section of the stuffing chamber is gradually widened wedgewise toward the exit, the filament yarn block is thermally set at the entrance of the stuffing chamber and makes loose travel through the stuffing chamber meandering towards the exit, thus losing much of the crimp uniformity of the filament yarn.

Incidentally, it should also be understood that means of composing the stuffing chamber in this invention are explained in connection with lamellae but they should not be construed as limiting the spirit or scope of this invention.

For instance, the stuffing chamber of this invention may be made of a plurality of rod materials which are arranged radially to form a chamber, a cylinder having multi perforations radially disposed in the walls, or a cylindrical wire netting.

The purpose of the cover 15 covering the lamellae 13 with the stuffing chamber 12 formed therein is not only reduce the noise of the hot fluid escaping through the spaces between the lamellae, but also makes it convinient to observe the stuffing condition of the filament yarn in the stuffing chamber when said cover 15 is made of transparent material.

Next, the staying control chamber 19 is composed of the hollow tube 20 having plural control perforations $h_1$–$h_8$ disposed radially in the walls, one end of which is securely fixed to the joint 18 and the other end has the cold fluid supply device 21 comprising from a cold fluid supply conduit 22, cold fluid chamber 23 and plural cold fluid supply perforations h′ disposed in the walls.

The cold fluid is jetted into the staying control chamber from an opposite direction of yarn processing direction or at a right angle to said direction through the plural cold fluid supply perforations h′ disposed in the walls of the hollow tube via the cold fluid supply conduit 22 and cold fluid chamber 23.

This results in cooling and fixing the crimped filament yarn in the staying control chamber and increment of crimping by back pressure caused by the cold fluid, and makes it easy to release the crimped filament yarn from the filament yarn block.

Moreover it is important that the apparatus of this invention can standardize the position of $P_2$ of the filament yarn block in the staying control chamber.

Consequently, this also results in the standardization of the position of the stuffing start point $P_1$, which is responsible for controlling the control factors in the crimping such as stuffing density, releasing point and so on. Each perforation ($h_1$–$h_8$) and the cold fluid supply perforations h' should be not more than 3 mm in diameter, preferably from 1 mm to 2 mm.

The inside diameter of the hollow tube 20 (staying control chamber) must be larger than the inside diameter of the stuffing chamber at the joint 18. If not, the filament yarn block in the stuffing chamber is hindered to make a smooth proceed into the staying control chamber.

Although the inside diameter of the hollow tube 20 (staying control chamber) varies depending upon the inside diameter of the stuffing chamber, it may range from 5 mm to 45 mm, preferably from 9 mm to 15 mm.

And its length varies depending upon the uniformity of the filament yarn; it may range from 10 mm to 200 mm, preferably from 50 mm to 100 mm.

In the illustrated embodiment (FIG. 1), the staying control chamber is composed of a hollow tube having many perforations disposed in the walls, but should not be construed as limiting the spirit or scope of this invention. For example, similar to the above-mentioned stuffing chamber, the staying control chamber may be composed of a plurality of lamellae or rod materials, which are arranged radially side by side.

That is to say, any of such staying control chambers can be applied to this invention, if said chamber is made to control the exhausting volume and the back pressure of the cold fluid in response to the longitudinal movement of the releasing point.

And the staying control chamber may also be surrounded by a cover having the cold fluid exhausting conduit on it.

The cap 24 with a take-up hole 25 is fixed at the end of the hollow tube 20, which arrangement induces the cold fluid to force its way opposing the yarn processing direction into the staying control chamber, muffling the noise of the cold fluid jetting through the cold fluid supply perforations h'.

The diameter of the yarn take-up hole 25 is from about 2 mm to 6 mm, preferably 3 mm to 5 mm. When the diameter of the yarn take-up hole 25 is not more than 2 mm, the crimped filament yarn is apt to be caught at the hole. On the other hand, when the hole is more than 6 mm in diameter, it may often allow the filament yarn block to come out through the hole without being released into a crimped yarn.

As indicated above, this invention is described by referring to FIG. 1 and FIG. 2, but should not be construed as limiting its scope to this.

In a word, the process of this invention comprises forcing the hot fluid entrained filament yarn into the stuffing chamber in one direction, forcing the cold fluid from an opposite direction into the staying control chamber located behind said stuffing chamber, exhausting the hot fluid from the stuffing chamber and the cold fluid from the staying control chamber.

The above-mentioned process according to this invention can be achieved by use of any apparatus comprising a hot fluid jet nozzle, stuffing chamber having a hot fluid exit, staying control chamber having a cold fluid exit, and cold fluid supply device set up in said order into an assembly.

For example, the basic design of the apparatus according to this invention can also be applied to a crimping apparatus which is constructed to have the whole apparatus divided axially into two portions, a body and a detachable cover, and also the cross section of the yarn processing bore, stuffing chamber, and/or staying control chamber may be made rectangular.

Figure 3:
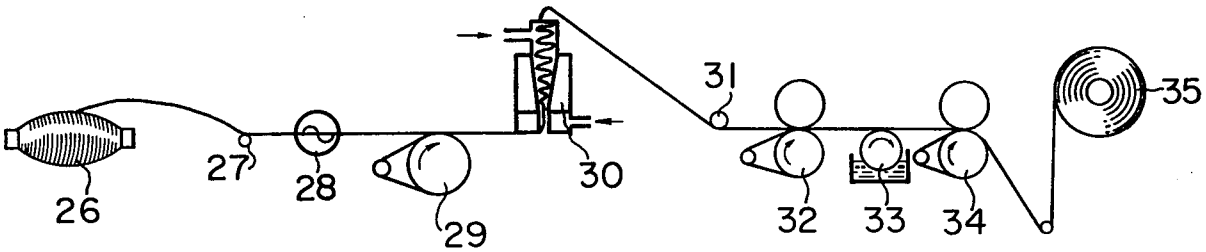
FIG. 3 is a schematic view of the present process using the apparatus shown in FIG. 1 and FIG. 2.

Turning to FIG. 3, a schematic view of the present process is shown there using the apparatus of FIG. 1 and FIG. 2.

The filament yarn Y drawn from a pirn 26 is preheated on the hot feed rolls 29 running at a constant rate, after it has passed its way via the guide 27 and the compensator 28, and overfed into the crimping apparatus 30.

Thus, crimps are formed in the filament yarn. Then, the filament yarn is drawn by means of take-up rolls 32 at a constant rate lower than that of the rolls 29 via the guide 31, oiled by means of the oiling roll 33, stretched and opened by means of the draft rolls 34 at a constant rate faster than that of the rolls 32, and then taken up into a package on the winder 35.

In FIG. 3, this invention is described in the event of the throw-ster texturing yarn process (TTY), but should not be limited to this process.

This invention may be applied not only to the drawing/texturing yarn process (DTY), but also to the spinning/drawing/texturing yarn process (SDTY).

Especially, this invention may be preferably applied to the spinning/drawing/texturing yarn process because of its high speed crimping efficiency achieved by this apparatus.

As for the filament yarns suitable for the process and apparatus according to this invention, any of thermoplastic filament yarns, such as polyamides (poly-εcaprolactam, polyhexamethylene adipamide, etc.), polyesters (polyethylene terephthalate, polybutylene terephthalate, etc.), polyolefines (polyethylene, polypropylene, etc.), and polyvinyls (polyvinyl chloride, polyacryronitrile, etc.), is applicable.

And preferred denier of the filament yarn is in the range of 30 to 5000.

The hot fluid suitable for use in conjunction with this invention may be hot air, steam, hot nitrogen, etc.

And the cold fluid suitable for use in conjunction with this invention may be cold air, nitrogen, steam, or air containing water mist, whose temperature is lower than the temperature of the hot fluid.

As described hereinabove, this invention relates to the apparatus and process comprising forcing the hot fluid entrained filament yarn into the stuffing chamber in one direction, forcing the cold fluid from an opposite direction into the staying control chamber located behind the stuffing chamber, exhausting the hot fluid from the stuffing chamber and the cold fluid from the staying control chamber, which structure causes and applies constant back pressure throughout the staying control chamber and the stuffing chamber, enhances the increment of crimping in the filament yarn, and standardizes the position of the stuffing start point $P_1$ and releasing point $P_2$.

Consequently, it is able to keep the stuffing density and stuffing volume of filament yarn in the stuffing chamber and staying control chamber to a specified degree to provide substantially much more uniform crimping with less problems than the prior arts.

This invention will now be described by referring to an example.

EXAMPLES

In the examples the apparatus as shown in FIGS. 1–3 was used with the exception of the oiling roll 33 and the drafting rolls 34 indicated in FIG. 3, and various kinds of drawing filament yarns were subjected to crimping process under conditions shown in Table 1. Results are shown in Table 1.

The values shown as "total crimp (TCo)" in the table were measured and calculated in the following manner:

Samples of crimped filament yarns were collected in a specified length. Then a load of 0.1 g/d was imposed on the sample and the length ($l_o$) thereof was measured.

The load was removed from the sample and the sample was dipped in boiling water for 20 minutes in the relaxed state to develop crimps further. Then the sample was taken up from the water and was allowed to stand so as to dry itself naturally. A load of 0.1 g/d was imposed on the sample and the length ($l_1$) thereof was measured. Then the load was removed from the sample and a load of 2 mg/d was imposed on the sample and the length ($l_2$) thereof was measured.

The value of the total crimp (TCo) was calculated from the following equation:

$$TCo = \frac{l_1 - l_2}{l_o} \times 100\ (\%)$$

TABLE 1

| Item | | Examples 1 | 2 | 3 | 4 | 5 | 6 |
|---|---|---|---|---|---|---|---|
| Filament yarn used: | Polymer | Poly-ε-caprolactam | Polyethylene terephthalate | Polyhexamethylene adipamide | Poly-ε-caprolactam | Poly-ε-caprolactam | Polypropylene |
| | Denier/filaments | 1050de/68fil | 150de/48fil | 1200de/68fil | 2300de/136fil | 1345de/68fil | 2320de/100fil |
| Hot feed rolls 29: | Temperature (°C.) | 160 | 190 | 190 | 190 | 190 | 125 |
| | Peripheral speed (m/min) | 900 | 450 | 450 | 1500 | 2500 | 450 |
| Hot fluid (air): | Temperature (°C.) | 220 | 230 | 250 | 190 | 200 | 140 |
| | Pressure (kg/cm$^2$) | 3 | 4 | 3.5 | 4 | 5 | 3.5 |
| Adapter yarn processing bore diameter (mm) | | 1.5 | 1.2 | 1.5 | 2.1 | 2.1 | 1.8 |
| Piece yarn processing bore diameter (mm) | | 1.7 | 1.5 | 1.7 | 2.9 | 2.9 | 2.4 |
| Piece hot fluid jet bore diameter (mm) | | 1.0mm × 2 | 0.9mm × 2 | 1.0mm × 2 | 1.9mm × 2 | 1.9mm × 2 | 1.5mm × 2 |
| Angle $\theta_1$ (degree) | | 25 | 30 | 30 | 30 | 30 | 30 |
| Plug yarn processing bore diameter (mm) | | 2.8 | 2.5 | 2.5 | 3.0 | 3.0 | 2.8 |
| Lamellae 13: | Number | 16 | 16 | 16 | 12 | 12 | 12 |
| | Thickness (mm) | 1 | 1 | 1 | 1 | 1 | 1 |
| Stuffing chamber: | Entrance, diameter (mm) | 5 | 4 | 5 | 5 | 5 | 5 |
| | Exit, diameter (mm) | 10 | 8 | 9 | 9 | 9 | 9 |
| | Length (mm) | 150 | 150 | 200 | 100 | 150 | 150 |
| Angle $\theta_2$ (degree) | | 2 | 2.5 | 2.5 | 1.5 | 1.5 | 2 |
| Hollow tube: | Diameter (mm) | 11 | 10 | 11 | 12 | 11 | 11 |
| | Length (mm) | 50 | 50 | 50 | 100 | 100 | 70 |
| Control Perforation: | Diameter (mm) | 1 | 1 | 1 | 1 | 0.8 | 1 |
| | Number per line | 4 | 4 | 4 | 4 | 4 | 4 |
| | Number of lines | 6 ($h_1$–$h_6$) | 6 ($h_1$–$h_6$) | 6 ($h_1$–$h_6$) | 20 ($h_1$–$h_{20}$) | 20 ($h_1$–$h_{20}$) | 15 ($h_1$–$h_{15}$) |
| Take-up hole, diameter (mm) | | 4 | 2 | 3 | 3 | 3 | 4 |
| Cold fluid (air at room temperature) pressure (kg/cm$^2$) | | 1.2 | 0.4 | 0.4 | 2 | 3 | 1.5 |
| Cold fluid supply perforation: | Diameter (mm) | 1 | 1 | 1 | 1 | 1 | 1 |
| | Number | 6 | 6 | 6 | 6 | 6 | 6 |
| Take-up rolls: | Peripheral speed (m/min) | 712 | 382 | 370 | 1245 | 2050 | 335 |
| Crimped filament yarn obtained: | Denier (de) | 1330 | 173 | 1450 | 2700 | 1600 | 2450 |
| | Tatal crimp (TCo, %) | 15.3 | 10.8 | 14.0 | 13.5 | 14.3 | 16.0 |

Two crimped filament yarns obtained in example 1 and example 3 were doubled respectively. Then, said doubled yarn and the single crimped filament yarn obtained in example 4, 5 and 6 were respectively twisted at a twist rate of S 40 T/m, and subjected to the tufting operation in order to make two types of carpets, a plain loop carpet and a high and low carpet (H/L).

To speak of the quality of the tufted carpets thus prepared, they had a clear H/L pattern, and the tops of loop piles were tufted uniformly to make an even surface to give a carpet having good quality and appearance.

Incidentally, the distance from the end of the plug yarn processing bore to the stuffing start point $P_1$ was constantly kept about 10 mm long in the examples 1–3 and about 20 mm long in the examples 4–6. On the other hand, the same apparatus used in examples 1–5 with the exception of the use of a hollow tube without control perforations disposed in the walls, was practiced for preparing crimped filament yarn under the same conditions, which, however, resulted in a constant fluctuation of the above-mentioned distance ranging from 0 to 30 mm, and a lack of crimp uniformity and unevenness of dyeing in the crimped filament yarn. Each of thus obtained crimped filament yarns was subjected to the tufting operation in same way as examples 1, 3, 4 and 5. But each tufted carpet prepared therefrom had an uneven surface, and was found utterly out of practical use.

What is claimed is:

1. A process for fluid crimping filament yarn, said process comprising forcing a hot fluid entrained filament yarn into a stuffing chamber in one direction to form a filament yarn block which extends into a staying control chamber downstream from said stuffing chamber, forcing a cold fluid into said staying control chamber in the opposite direction, exhausting the hot fluid from a hot fluid outlet located in said stuffing chamber, and exhausting the cold fluid through a plurality of exhaust orifices located in series along the length of said staying control chamber whereby the end of said filament yarn block in said staying control chamber controls the number of orifices exposed for outlet of said cold fluid to control the back pressure acting on the filament yarn block.

2. The process of claim 1 wherein said hot fluid is hot air at a pressure ranging from about 4 to 10 kg/cm$^2$ and a temperature ranging from about 180° to 250° C.

3. The process of claim 1 wherein said hot fluid is steam at a pressure ranging from about 4 to 10 kg/cm$^2$ and a temperature ranging from about 160° to 230° C.

4. The process of claim 1 wherein said cold fluid is air at a pressure ranging from about 0.4 to 3.0 kg/cm$^2$ and a temperature ranging from about 20° to 40° C.

5. An apparatus for crimping yarn comprising a stuffing chamber having a hot fluid jet nozzle at one end thereof to plasticize and drive a filament yarn into said stuffing chamber and a hot fluid outlet to exhaust the hot fluid separated from the filament yarn supplied through said hot fluid jet nozzle, a staying control chamber disposed in communication with said stuffing chamber downstream thereof, said staying control chamber having a cold fluid supply device located adjacent an end thereof remote from said stuffing chamber and a plurality of small outlet orifices located in series along the length of said staying control chamber through which the cold fluid may be exhausted to control the back pressure acting on a filament yarn block located in said stuffing chamber and said staying control chamber.

6. The apparatus of claim 5 wherein said hot fluid jet nozzle is composed of an adapter having a yarn processing bore in its central part, piece having a yarn processing bore in its central part with at least one of hot fluid jet bores imposed symmetrically in the piece at an acute angle with said yarn processing bore, and plug having a yarn processing bore in its central part.

7. The apparatus of claim 6 wherein the diameter of the yarn processing bore of said adapter is not less than 1.5 mm.

8. The apparatus of claim 6 wherein the diameter ratio of the yarn processing bore of said adapter to the yarn processing bore of said piece is less than 1.0.

9. The apparatus of claim 6 wherein the diameter ratio of the hot fluid jet bore of said piece to the yarn processing bore of said piece is less than 0.8.

10. The apparatus of claim 6 wherein the diameter of the hot fluid jet bore of said piece is not less than 1.0 mm.

11. The apparatus of claim 6 wherein the diameter of the yarn processing bore of said plug is larger than the diameter of the yarn processing bore of said piece, but is less than 10 mm.

12. The apparatus of claim 6 wherein said hot fluid jet bores of the piece disposed at an angle of ranging approximately from 10° to 50° with the axis of said yarn processing bore.

13. The apparatus of claim 5 wherein said stuffing chamber is made of a plurality of lamellae arranged radially having a narrow spaces along the whole length at their root with the neighboring lamellae.

14. The apparatus of claim 13 wherein the number of said lamellae is from 10–30.

15. The apparatus of claim 13 wherein the configuration of said lamellae is disposed to form a flare at an angle of $\theta_2$ at the entrance of said stuffing chamber.

16. The apparatus of claim 15 wherein said angle of $\theta_2$ is made to be from about 0.5° to 5°.

17. The apparatus of claim 5 wherein said stuffing chamber has an entrance diameter of 2 mm to 20 mm and exit diameter of 4 mm to 40 mm and more than 10 mm in length.

18. The apparatus of claim 5 wherein said staying control chamber is composed of a hollow tube having a plurality of control perforations disposed in the walls.

19. The apparatus of claim 18 wherein the diameter of said control perforations is less than 3 mm.

20. The apparatus of claim 5 wherein said staying control chamber has a diameter of 5 mm–45 mm and is 10 mm–200 mm in length.

21. The apparatus of claim 5 wherein said cold fluid supply device is composed of a plurality of cold fluid supply perforations disposed in the walls.

22. The apparatus of claim 21 wherein the diameter of said cold fluid supply perforations is less than 3 mm.

* * * * *